US010378761B2

(12) United States Patent
Lee

(10) Patent No.: US 10,378,761 B2
(45) Date of Patent: Aug. 13, 2019

(54) HOSPITAL WASTE PLASMA INCINERATOR

(71) Applicant: Sung Joo Lee, Seoul (KR)

(72) Inventor: Sung Joo Lee, Seoul (KR)

( * ) Notice: Subject to any disclaimer, the term of this patent is extended or adjusted under 35 U.S.C. 154(b) by 0 days.

(21) Appl. No.: 15/588,632

(22) Filed: May 6, 2017

(65) Prior Publication Data

US 2018/0245791 A1 Aug. 30, 2018

(30) Foreign Application Priority Data

Sep. 6, 2016 (KR) ..... 10-2016-0114326

(51) Int. Cl.
*F23G 7/06* (2006.01)
*F23G 5/027* (2006.01)

(52) U.S. Cl.
CPC ..... *F23G 7/06* (2013.01); *F23G 5/0273* (2013.01); *F23G 2201/303* (2013.01); *F23G 2204/201* (2013.01); *F23G 2204/203* (2013.01); *F23G 2207/10* (2013.01); *F23G 2209/20* (2013.01)

(58) Field of Classification Search
CPC ..... F23G 7/06
See application file for complete search history.

(56) References Cited

U.S. PATENT DOCUMENTS 5,798,496 A * 8/1998 Eckhoff ..... C10B 1/10 110/241
6,388,225 B1 * 5/2002 Blum ..... H05H 1/46 219/121.43
2003/0221597 A1 * 12/2003 Barba ..... F23C 7/002 110/342
2007/0007257 A1 * 1/2007 Uhm ..... H05H 1/30 219/121.48
2008/0247904 A1 * 10/2008 Paskalov ..... A61L 11/00 422/22
2010/0048975 A1 * 2/2010 Uhm ..... A62D 3/178 588/311
2012/0235569 A1 * 9/2012 Lee ..... H05H 1/46 315/111.41

FOREIGN PATENT DOCUMENTS

KR 10-1998-0057682 9/1998
KR 10-2007-0056390 6/2007
KR 10-2010-0104674 9/2010

* cited by examiner

*Primary Examiner* — Nathaniel Herzfeld

(57) ABSTRACT

The present invention provides a hospital waste plasma incinerator that has a following features. It is composed of a main body having an inlet and a cap for opening and closing the inlet, a pyrolysis incinerator for receiving the hospital waste that is disposed in the interior of the main body and connected with the inlet, a plasma flame generator installed inside the main body and generating a plasma flame toward the pyrolysis incinerator, a complete combustion device which is installed in the main body and completely burns the smoke and the odor generated due to the incineration with a plasma flame of 1,500 to 3,000° C., a complete combustion exhaust device connected to the complete combustion device to exhaust the combustion gas, and the cooling device for cooling the combustion gas.

7 Claims, 4 Drawing Sheets

HOSPITAL WASTE PLASMA INCINERATOR

FIELD OF INVENTION

The present invention relates to a hospital waste plasma incinerator, and more particularly, to a hospital waste incinerator in which hospital waste is directly pyrolyzed and incinerated at a source site and the IOT (Internet of things) is applied.

BACKGROUND OF INVENTION

Because medical waste are at risk of infection, specialized medical waste handling companies collect medical waste from hospitals or pharmacies and transport it to a separate location for disposal.

However, there is still concern about infection that can occur during the collection and transportation process, even if the specialized processing company professionally collects and transports it and handles it well in specialized processing facilities.

Therefore, it is ideal to incinerate directly from the source as soon as hospital waste is generated. However, due to the characteristics of the incinerators, there is a problem that is to solve such as the space tor installing the incinerator and the odor and smoke generated in the incineration process.

PRIOR ART LITERATURE

Korean Patent Publication No. 10-2010-0104674 (Sep. 29, 2010. Disclosures disposal method of hazardous waste)

Challenge to Solve

The present invention has been made to solve all the problems of the prior art as described above. The object of the present invention is to provide the hospital waste plasma incinerator which can completely burn the smoke and the odor generated in the pyrolysis process with the plasma flame, reduce the energy by supplying the remaining plasma energy after the combustion of smoke and odor to the incinerator and be used in a hospital room because of no pollutant except ashes

Solution to the Problem

In order to achieve the above object, the hospital waste plasma incinerator of the present invention includes the following devices.

1. A main body having an inlet and a cap for opening and closing the inlet.
2. A pyrolysis incinerator disposed inside the main body to be connected to the inlet.
3. A pyrolysis incinerator disposed inside the main body to be connected to the inlet.
4. A plasma flame generator installed inside the main body and generating a plasma flams toward the pyrolysis incinerator.
5. A complete combustion device installed in the main body and completely burning the smoke and the odor with a plasma flame of 1,500 to 3,000° C.
6. Exhaust divide connected with complete combustion device to exhaust completely burned gas.
7. A cooling device for cooling the combustion gas.

The plasma flame generator is preferable to include a waveguides a microwave generator installed at a lower end of the waveguide to generate a microwave, and a plasma flame torch provided at the other side of the waveguide.

The plasma flame torch part is preferable to include a flame torch generating a flame at 1,500 to 3,000° C. and a swirl gas blowing device for sending a swirl gas at 30 to 40 L/min to a flame torch.

It is preferable that a complete combustion removing device is provided between the pyrolysis incinerator and the waveguide.

The complete combustion device is a bell-shaped with a wide bottom portion and a narrow top portion, and a pipe penetrating up and down is installed, and a flame torch is inserted into the pipe.

The bottom of the complete combustion device is connected to a pipe passing through the upper and lower parts, and thus the outside air is blocked.

In the middle of the complete combustion device, there is provided a discharge port having a plurality of through holes for supplying the flame torch with the smoke and the odor so that the smoke and the odor can be completely removed by the flame.

It is preferable that the through-going outlet of the ventilation hole is provided with a blade twisted to one side so as to rotate in the rotating direction of the swirl gas.

It is preferable that a microwave oscillation opening is formed at one side of the waveguide.

It is preferable that a plasma flame outlet connected to the swirl gas blower and connected to the flame torch is formed.

It is preferable that a heat insulating material is provided on the outer periphery of the body of the pyrolysis incinerator with a certain thickness.

The inner bottom of the pyrolysis incinerator is preferably provided with an air inlet for supplying a small amount of oxygen.

A sensor is installed in each of the pyrolysis incinerator, the plasma flame generating device, the complete combustion device, the exhaust device, and the cooling device provided inside the main body. And IOT (Internet of things) applied to the incinerator is provided for notifying the content detected by the sensor in a malfunction or abnormal operation is transmitted to the manager and the control center.

Effects of the Invention

The present invention is compact, operates with a closed system and has the effect of preventing secondary environmental pollution by completely burning the smoke and the odor generated in the incineration process with the plasma flame.

In addition, according to the above-mentioned function since the present invention can incinerate hospital wastes at the hospital room immediately after the generation of it, it is not necessary to collect and transport the hospital wastes, thereby reducing the costs and risk of infection.

SUMMARY OF INVENTION

The present invention provides a hospital waste plasma incinerator that has a following features. It is composed of a main body having an inlet and a cap for opening and closing the inlet, a pyrolysis incinerator for receiving the hospital waste that is disposed in the interior of the main body and connected with the inlet, a plasma flame generator installed inside the main body and generating a plasma flame toward the pyrolysis incinerator, a complete combustion device which is installed in the main body and completely burns the smoke and the odor generated due to the incineration with a plasma flame or 1,500 to 3,000° C., a complete combustion exhaust device connected to the complete combustion device to exhaust the combustion gas, and the cooling device for cooling the combustion gas.

DETAILED DESCRIPTION EMBODIMENTS OF INVENTION

Figure 1:
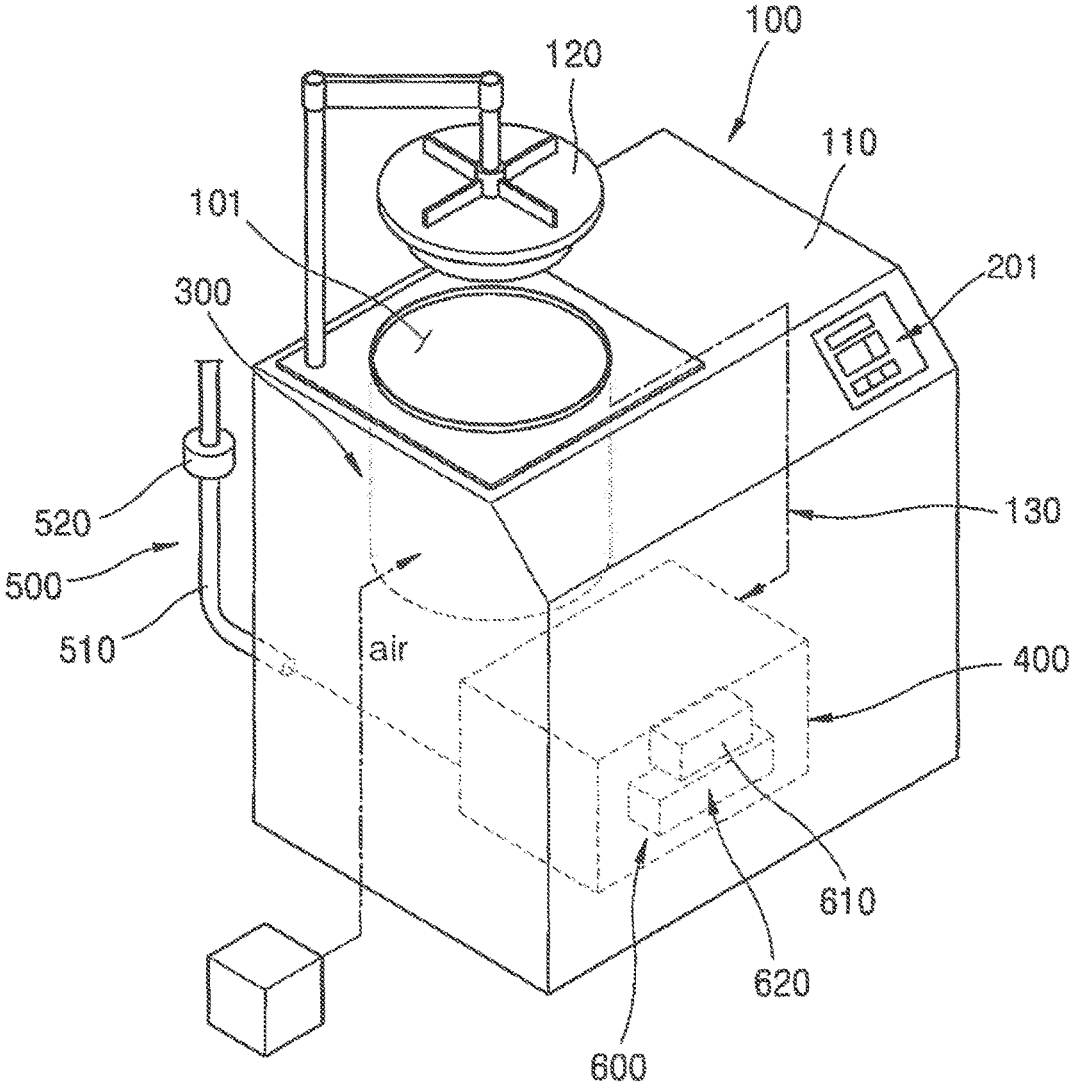
FIG. 1 is a perspective view of a hospital waste plasma incinerator of the present invention.

Hereinafter, embodiments of the present invention will be described in detail so that those skilled in the art can easily carry out the present invention with reference to the drawings.

In order to clearly illustrate the present invention, parts not related to the description are omitted, and the same or similar components are denoted by the same reference numerals throughout the specification.

Hereinafter, the provision or arrangement of any structure on the top (or bottom) of the substrate means that any structure is provided or disposed in contact with the top surface (or bottom surface) of the substrate.

Furthermore, the present invention is not limited to the above-described (or later-described) description and is not limited to not including other configurations between arbitrary configurations provided or arranged in the description.

Hereinafter, a hospital waste plasma incinerator of the present invention will be described with reference to the drawings.

Figure 2:
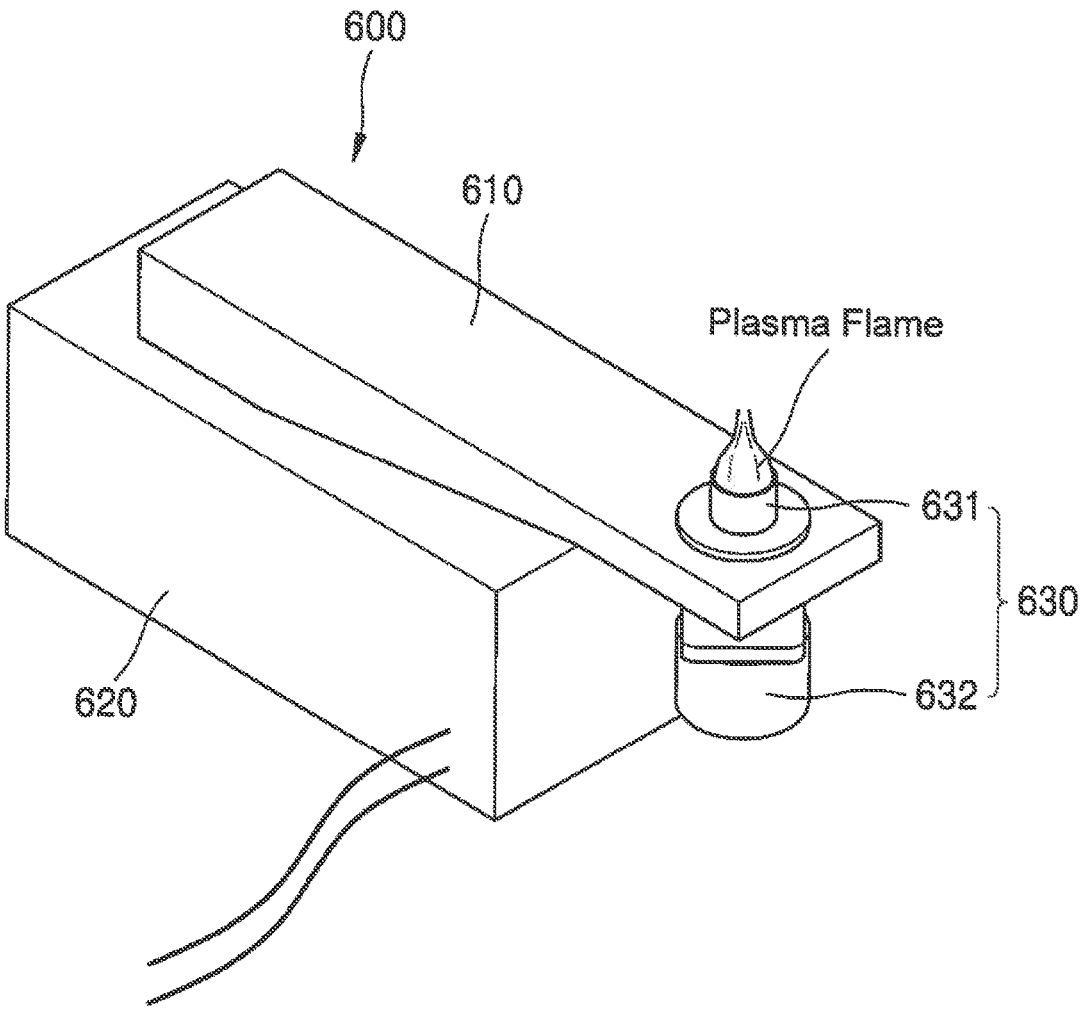
FIG. 2 is a perspective view showing a plasma flame generating apparatus according to the present invention.
Figure 3:
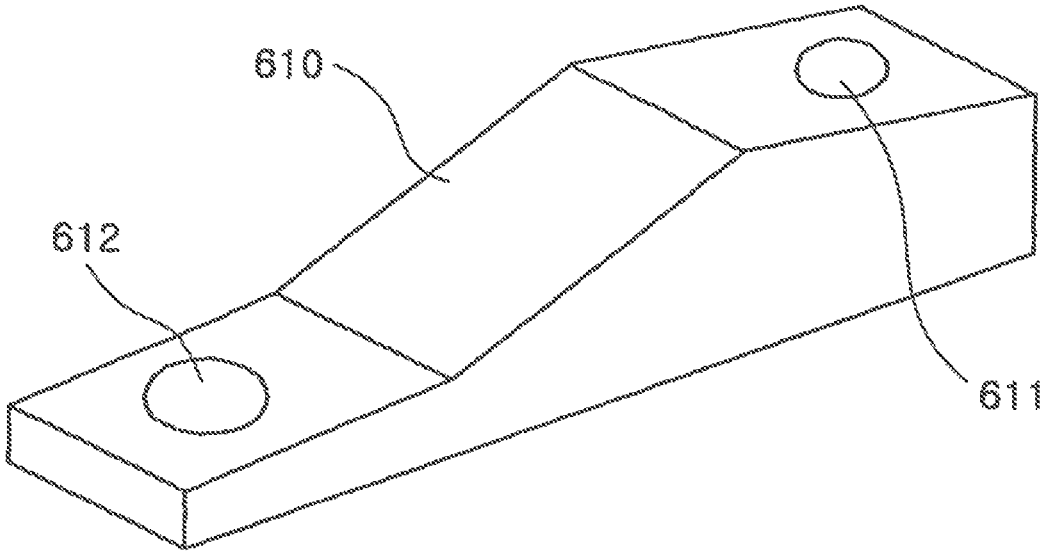
FIG. 3 is a perspective view showing a waveguide according to the present invention.
Figure 4:
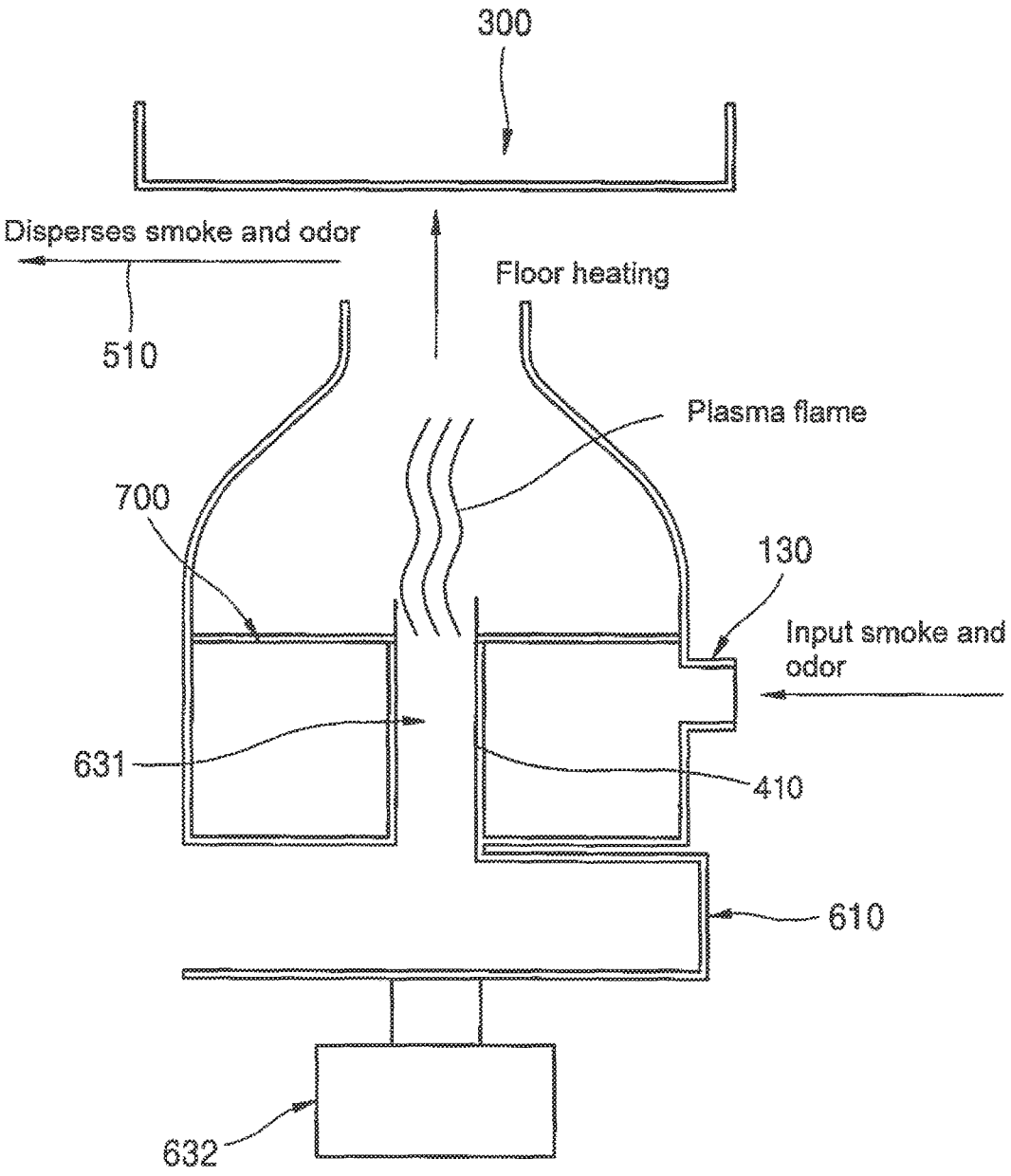
FIG. 4 is a conceptual diagram showing an example in which a ventilation hole according to the present invention is installed.

FIG. 1 is a perspective view showing a hospital waste plasma incinerator of the present invention. FIG. 2 is a perspective view showing a plasma flame generating apparatus according to the present invention. FIG. 3 is a perspective view showing a waveguide according to the present invention. FIG. 4 is a conceptual view showing an example in which a ventilation hole.

Referring to FIG. 1 to 3, the hospital waste plasma incinerator (100) of the present invention comprises the following devices.

A main body (110) having an inlet (101) and a cap (120) for opening and closing the inlet (101), A pyrolysis incinerator (300) disposed inside the main body (110) and connected to the inlet (101), A plasma flame generator (600) installed in the main body (110) and generating a plasma flame toward the pyrolysis incinerator (300), A complete combustion device (400) installed in the main body (!1) for completely burning the smoke and the odor generated during incineration with a plasma flame of 1,500 to 3,000° C., An exhaust device connected to the complete combustion device to exhaust the combusted gas, A cooling device (520) for cooling the combustion gas.

Here, although the drawing number is not shown, with reference to FIG. 1, the main body (110) is provided with a rotating device.

The rotating device includes a rotating shaft installed to rotate on the upper end of the main body (110) and a connecting rod connecting the upper end of the cap (120) to the upper end of the rotating shaft. The rotary shaft is moved up and down by driving the elevator.

Accordingly, the cap (120) can be positioned to open and close the inlet (101) by the rotating device.

Referring to FIGS. 2 and 3, a plasma flame generator (600) according to the present invention includes a waveguide (610), a microwave generator (620) installed at a lower end of the waveguide (610) to generate a microwave and a plasma flame burner (630) installed on the other side.

The plasma flame burner (630) includes a flame torch (631) generating a flame at 1,500 to 3,000° C. and a swirling gas blower (632) for sending a swirling gas at 30 to 40 L/min to a flame torch (631).

Referring to FIG. 6, it is preferable that a complete combustion device (400) is installed between the pyrolysis incinerator (300) and the waveguide (610).

The complete combustion device (400) has a general bell shape, that is, a wide bottom portion and a narrow top portion.

A flame torch (630) is installed inside the complete combustion device (400). The flame torch (631) is inserted into a pipe (410) passing through the top and bottom.

The bottom of the complete combustion device (400) is connected to the pipe (410) to block the outside air.

In the middle of the complete combustion device (400), a ventilation hole (700) having a plurality of through-outs (not shown) is provided. This is for supplying the smoke and the odor to the flame torch (631) so that the smoke and the odor can be completely burned by the flame which is ignited in the flame torch (631). It is preferable that the through-going outlet of the ventilation hole (700) is provided with a wing that is twisted to one side so as to rotate in the swirl gas rotation direction. This is so that smoke and the odor can be easily supplied to the flame torch so that it can be completely burned.

The through-outlet is not limited to a twisted wing, and may be a plurality of through-holes.

Referring to FIG. 3, at one side of the waveguide (610) according to the present invention, a microwave oscillation opening (611) is formed.

According to the present invention, a plasma flame discharge port (612) connected to the swirl gas blower (632) and connected to the flame torch (631) is formed.

In addition, a heat insulating material (not shown) is provided on the outer periphery of the body of the pyrolysis incinerator (300) to have a predetermined thickness.

Referring to FIG. 1, an exhaust apparatus (500) according to the present invention includes an exhaust pipe (510) and an exhaust pump (not shown).

The exhaust pipe (510) is protruded to the outside of the main body (110) to discharge the smell and combustion gas of the hospital waste generated during the incineration by the plasma flame burner (630) to the outside.

The exhaust pump is connected to the exhaust pipe (510) to forcibly exhaust the combustion gas.

Smoke and odor generated by the complete combustion of the plasma flame at 1,500 to 3,000° C. through the exhaust pipe (510) are easily discharged.

That is, since the plasma flame heats the outer bottom of the pyrolysis incinerator (300) and one end of the exhaust pipe (510) of the exhaust apparatus (500) is located at the outer bottom of the pyrolysis incinerator (300), It is possible to easily exhaust the smoke and the odor generated by incineration.

Further, the cooling device (520) according to the present invention is installed on the exhaust pipe (510), and can cool the temperature of the combustion gas that is burned and discharged at a high temperature to a set temperature.

The cooling device (520) may be a water-cooled or air-cooled type, or a cooling coil may be used.

In the main body (110) according to the present invention a control panel (201) is installed.

The control panel (201) installed in the main body (110) can be easily controlled by the user and includes switches for operating the apparatus and a temperature display window for displaying the temperature of the pyrolysis incinerator (300).

An air inlet (not shown) is provided at the inner bottom of the pyrolysis incinerator (300). This is to supply a small amount of oxygen. That is, when the bettors of the pyrolysis incinerator (300) is heated due to the flams of the plasma torch, A small amount of oxygen is supplied through the inlet so that the ignition can be performed more smoothly.

A small amount of oxygen supplied through the air inlet is supplied by a pressurizing pump such as a small air compressor connected outside the incinerator (100).

The hospital waste plasma incinerator according to the present invention is equipped with the IOT (Internet Of Things, not shown). This is accomplished by installing a sensor (not shown) for detecting malfunction and abnormal operation in each of the pyrolysis incinerator (300), the plasma flame generator (600), the complete combustion device (400), the exhaustion device (500) and the cooling device (520). Malfunction and abnormal operation is detected by the sensor and then contents detected by the sensor are notified to the administrator and the control center (not shown) wirelessly or by wire. Therefore the administrator can quickly check for malfunctions and abnormal operations.

The plasma incinerator of the present invention is advantageous in that the plasma incinerator is small in size and operates in a closed system and the smoke and the odor generated in the incineration process are completely burned by the plasma flame to prevent secondary environmental pollution.

The embodiment according to the present invention is advantageous in that the collection and transportation are not necessary by treating the hospital waste immediately in the hospital room as described above, thus reducing the secondary infection concern and the processing cost.

Although specific embodiments of the hospital waste plasma incinerator of the present invention, have been described above, it is apparent that various modifications can be made without departing from the scope of the present invention.

Therefore, the scope of the present invention should not be limited to the embodiments described, but should be determined by the equivalents of the claims, as well as the following claims.

It is to be understood that the above-described embodiments are illustrative in all aspects and should not be construed as limiting, and the scope of the present invention is indicated by the appended claims rather than the foregoing description. All changes or modifications that come within the scope of the present invention and its equivalent should be construed as being included within the scope of the present invention.

EXPLANATION OF SYMBOLS

110: The body portion
201: control panel
300: Pyrolysis incinerator
400: Complete combustion eliminator
500: Exhaust system
600: Plasma flame generator

What is claimed is:

1. A hospital waste plasma incinerator comprising:
a main body having an inlet and a cap for opening and closing the inlet;
a pyrolysis incinerator disposed in the main body and connected with the inlet to receive a hospital waste;
a plasma flame generator installed inside the main body that generates a plasma flame towards the pyrolysis incinerator to incinerate the hospital waste;
a complete combustion device installed in the main body that completely burns smoke and odor generated from incineration of the hospital waste with a plasma flame of 1,500° C. to 3,000° C.;
a complete combustion exhaust device connected to the complete combustion device to exhaust combustion gas; and
a cooling device for cooling the combustion gas.

2. The hospital waste plasma incinerator of claim 1,
wherein the plasma flame generator includes a waveguide, a microwave generator installed at a lower side of one side of the waveguide to generate a microwave, and a plasma flame torch part provided at a second side of the waveguide, and
wherein the plasma flame torch part includes
a flame torch; and
a swirling gas blowing device,
wherein the flame torch is constructed to generate a flame of 1,500° C. to 3,000° C., and
wherein the swirling gas blowing device is constructed to send a swirling gas of 30 to 40 L/min to the flame torch.

3. The hospital waste plasma incinerator of claim 2,
wherein the plasma flame generator further includes a microwave oscillation opening formed at a second side of the waveguide; and
a plasma flame discharge port connected to the swirling gas blower and the flame torch.

4. The hospital waste plasma incinerator of claim 1,
wherein insulation material is installed around the pyrolysis incinerator.

5. The hospital waste plasma incinerator of claim 1,
wherein the complete combustion device is disposed between the pyrolysis incinerator and the waveguide,
wherein the complete combustion device includes a vertically penetrating pipe having a flame torch inserted therein,
wherein a bottom of the complete combustion device blocks external air, and
wherein a vent having a plurality of through-outs is installed in a middle of the complete combustion device to supply the smoke and the odor to the flame torch so that the smoke and the odor can be completely burned by flames provided by the flame torch.

6. The hospital waste plasma incinerator of claim 1,
wherein an inner bottom of the pyrolysis incinerator has an air inlet to supply a small amount of oxygen.

7. The hospital waste plasma incinerator of claim 1 further comprising:
a sensor is installed in each of the pyrolysis incinerator, the plasma flame generating device, the complete combustion device, the complete combustion exhaust device and the cooling device provided inside the main body, wherein the sensor includes an IOT (internet of things) that allows the sensor to notify an administrator and a control center of any malfunctions or abnormal operating conditions detected wirelessly or by wire.

* * * * *